United States Patent [19]

Hiller von Gaertringen

[11] 4,355,672

[45] Oct. 26, 1982

[54] APPARATUS FOR REMOVING BRANCHES AND BARK FROM FELLED TREES

[76] Inventor: Johann C. F. Hiller von Gaertringen, Schloss, 8601 Weiher, Fed. Rep. of Germany

[21] Appl. No.: 15,805

[22] Filed: Feb. 27, 1979

[30] Foreign Application Priority Data

Feb. 28, 1978 [DE] Fed. Rep. of Germany ..... 2808613

[51] Int. Cl.[3] ..... B27L 1/00

[52] U.S. Cl. ..... 144/208 E; 144/2 Z

[58] Field of Search ..... 144/2 Z, 208 R, 208 E, 144/311

[56] References Cited

U.S. PATENT DOCUMENTS

| | | | |
|---|---|---|---|
| 3,409,057 | 11/1968 | Los | 144/2 Z X |
| 3,516,462 | 6/1970 | Martinson et al. | 144/2 Z X |
| 3,672,413 | 6/1972 | Jouppi | 144/2 Z |
| 3,690,351 | 9/1972 | Strickland et al. | 144/2 Z |
| 3,770,030 | 11/1973 | Palfy | 144/208 E X |
| 3,809,134 | 5/1974 | McCabe | 144/2 Z |

FOREIGN PATENT DOCUMENTS

| | | | |
|---|---|---|---|
| 31228 | 2/1961 | Finland | 144/208 E |
| 564153 | 7/1977 | U.S.S.R. | 144/2 Z |

*Primary Examiner*—W. D. Bray

*Attorney, Agent, or Firm*—Becker & Becker, Inc.

[57] ABSTRACT

An apparatus for cutting off branches and debarking of felled trees which are pulled through a stationary knife system having a plurality of knives extending transversely with respect to the tree trunk axis is disclosed. In accordance with a preferred embodiment a plurality of knives for cutting off branches and a plurality of knives for removing the bark is swingably secured on shafts which extend in parallel with respect to the axis of a ring and secured thereto, which ring surrounds the trunk being pulled therethrough. The knives can be swung about the shafts and are resiliently pressable against the trunk by drive means. The knives for debarking are arranged on a forward face, with respect to the direction of travel of the trunk, of the ring and are disposed with their broad sides with respect to the trunk at a small angle of incidence with respect to the tree surface while the cutting edges of the debarking knives extend at an angle of from 20° to 60° with respect to the forward surface and the debarking knives are staggeredly arranged in the direction of the axis of the ring. The knives for cutting off the branches are disposed on a rearward surface of the ring, in the direction of the movement of the trunk, and their broad sides extend parallel with respect to the trunk surface while their cutting edges extend parallel with respect to the ring surface on which they are mounted. The knives for cutting off branches are staggeredly arranged with respect to each other in the direction of the axis of the ring.

22 Claims, 7 Drawing Figures

APPARATUS FOR REMOVING BRANCHES AND BARK FROM FELLED TREES

This invention relates to an apparatus for cutting off the branches and debarking of felled trees by means of a stationary cutting apparatus which surrounds the trunk of the tree with the knives of the apparatus being tangentially disposed with respect to the longitudinal central axis of the trunk.

BACKGROUND OF THE INVENTION

There is known an apparatus through which the tree trunks are pulled, after the cutting off the larger branches by means of a cutting device. At its entrance end the cutting device comprises wedge-formed knives for cutting off the branches and following these knives, the entrance end comprises a plurality of U-shaped knives which are staggered in the direction of the longitudinal axis of the tree, as well as in the direction of its circumference, and attack the surface of the trunk, under the impact of springs, with the bent portion of the U-shaped cutting edge. Thus, the bark is removed in strips from the tree in a manner comparable to the utilization of scoop knives. The knives are arranged on a frame which can be opened for the insertion of the tree trunk. Next the trunk is gripped at its lower end by a claw secured to a tractor and it is then moved by the efforts of the tractor through the cutting apparatus.

It is a disadvantage of such apparatus that a truly "white" bark removal from the trunk cannot be achieved since the U-shaped cutting knives leave ridges or strips of the bark.

Furthermore, the staggered arrangement of the knives in the direction of the longitudinal axis of the tree leads to considerable length of the cutting apparatus and thereby requires a very precise alignment of the tree along its axis. It is a further disadvantage that the resultant strips of the bark tend to accumulate in the region of the cutting knives which requires work stoppages in order to remove the bark peelings from the cutting knives. The curved knives are furthermore very expensive to produce, and it is finally a considerable disadvantage that the lower part of the trunk and the sections adjacent thereto are not reached by the cutting apparatus and these sections have to be cleaned manually.

Also apparatus have been proposed wherein the knives for cutting off the branches and for peeling off the bark are individually secured to a leaf spring staggeredly and in overlapping manner to a wide chain which chain tangentially surrounds the tree trunk. The disadvantage of this arrangement resides in the fact that the chain disposed transversely to the longitudinal tree trunk axis, i.e., transversely with respect to the direction of movement of the apparatus, is subjected to a considerable frictional resistance, or, at times, even would come to a halt because of protrusions on the tree trunk. Also, the knives may cut into protrusions of wood which can lead to a disengagement of the spring which carries a knife. Furthermore, in order to embrace the entire curvature of the tree trunk, a plurality of such chains have to be provided. This means that the chains have to be arranged in offset relation with respect to each other which, again, leads to an increase of the length of the apparatus.

Both proposals just described exhibit the shortcoming that the knives which cut off the branches are positioned at a considerable distance from the head of the cutting apparatus. Consequently, a further increase of the length of the entire apparatus will be necessary, even though such length to begin with is considerable. This leads to the requirement that the tree trunk has to be aligned very accurately which accounts for a considerable additional effort during operation of the apparatus.

BRIEF SUMMARY OF THE INVENTION

It is an object of the present invention to avoid the disadvantages of the prior art whereby the branch cutting and bark removal devices have an effective length which is as small as possible, with which a complete "white" peeling of the trunk is achieved, and in which the resulting peeled-off bark does not accumulate near the cutting knives or is caught therein and, furthermore, can be removed with ease.

These and other objects and advantages of the invention will appear more clearly from the following specification in connection with the accompanying drawings, in which:

IN THE DRAWINGS

Figure 3:
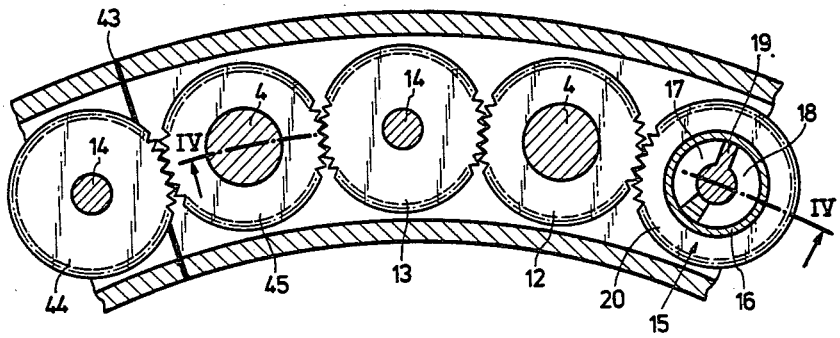
FIG. 3 is a section, in part, along line III—III of FIG. 2.
Figure 3A:
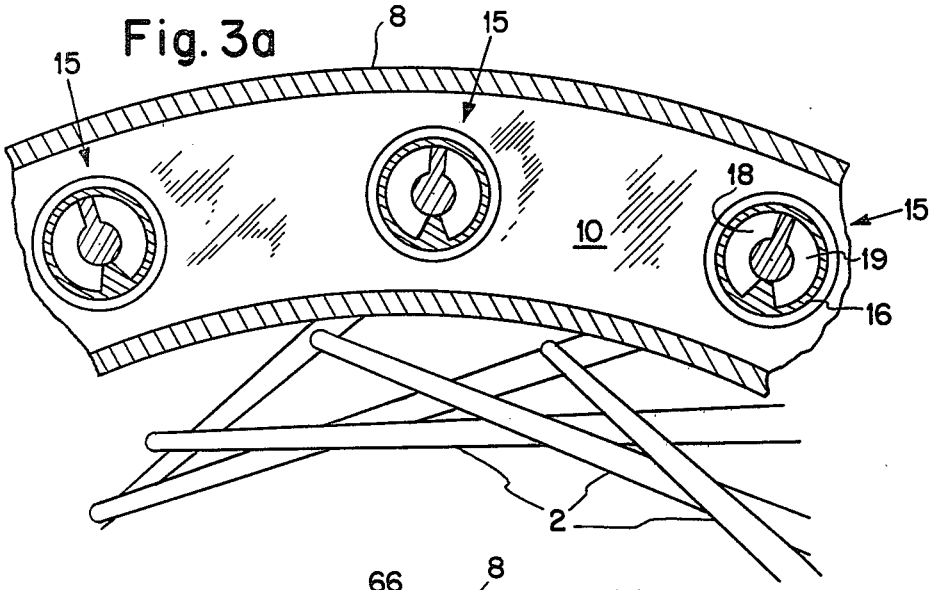
Figure 3B:
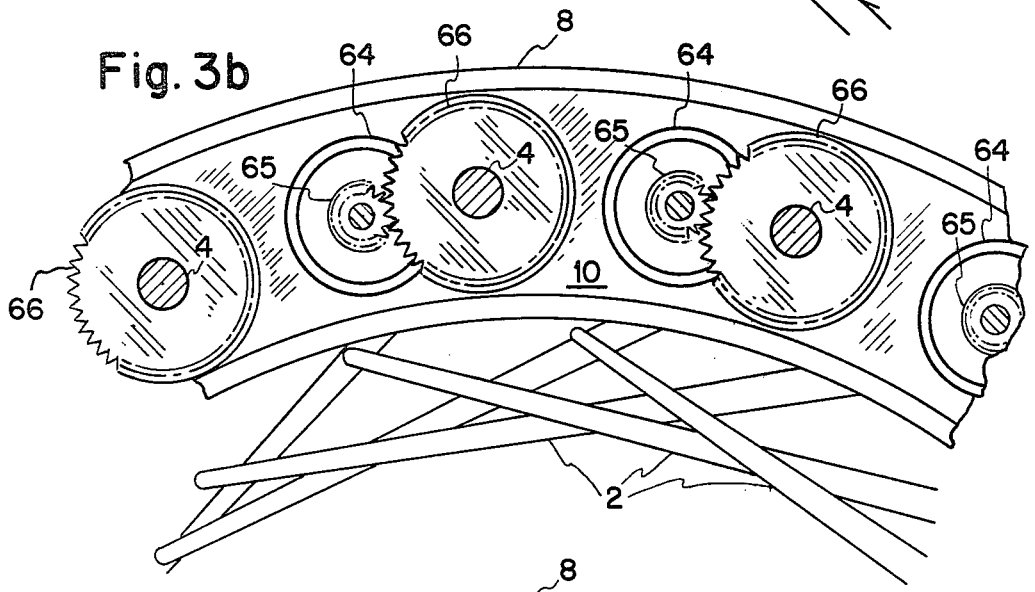

FIGS. 3*a* and 3*b* show sections similar to FIG. 3 but with hydraulic and electrical individual drives respectively for knife shafts.

Figure 2:
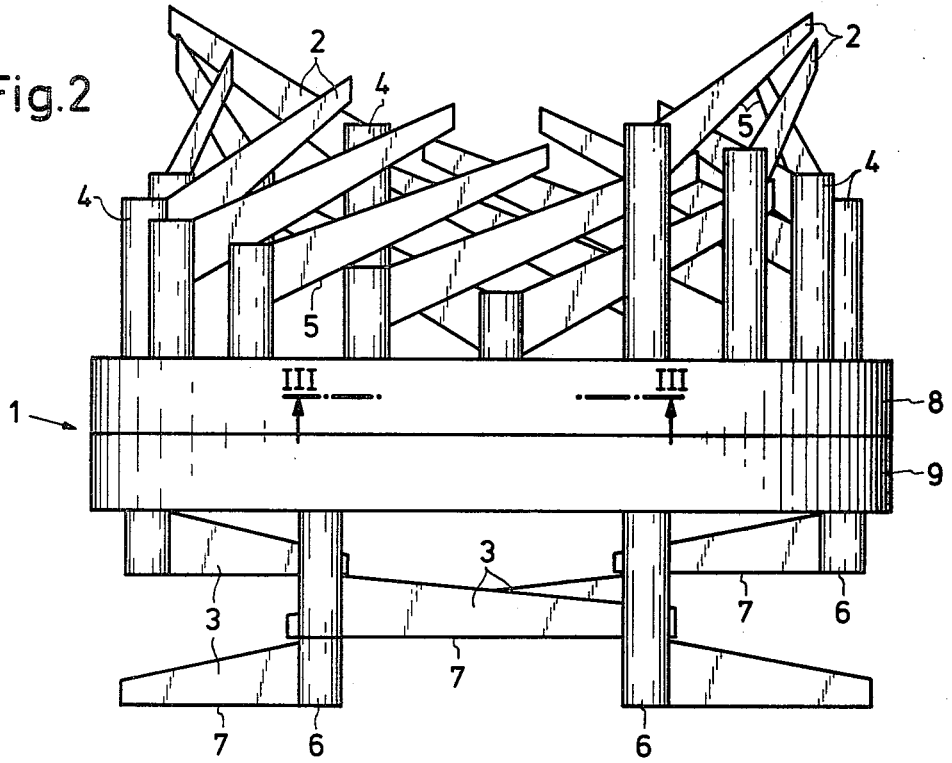
FIG. 2 is an end view showing the ring member, the debarking knives and the branch cutting knives.
Figure 4:
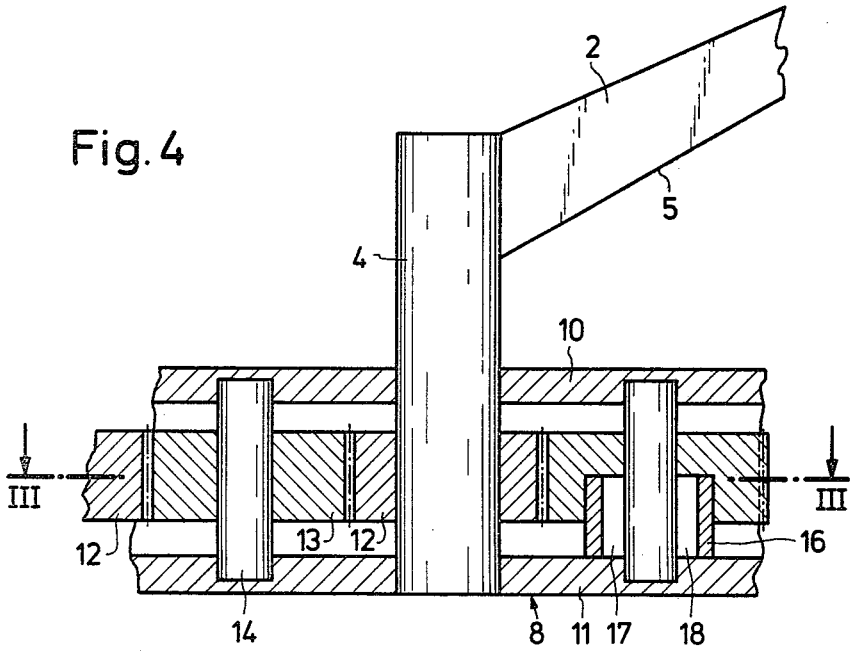
Figure 5:
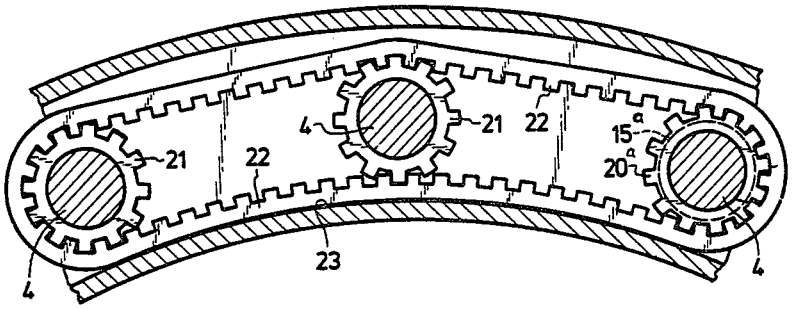
Figure 8:
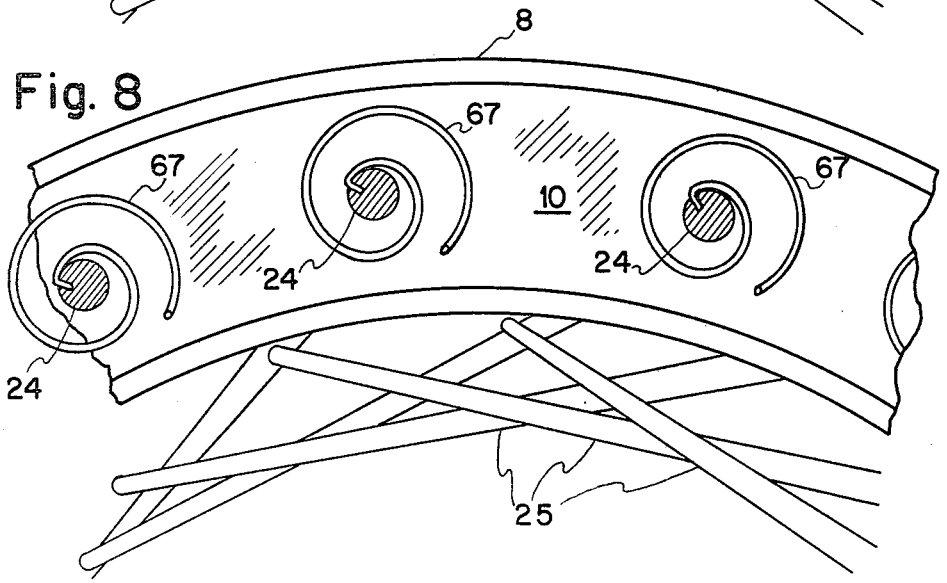
Figure 6:
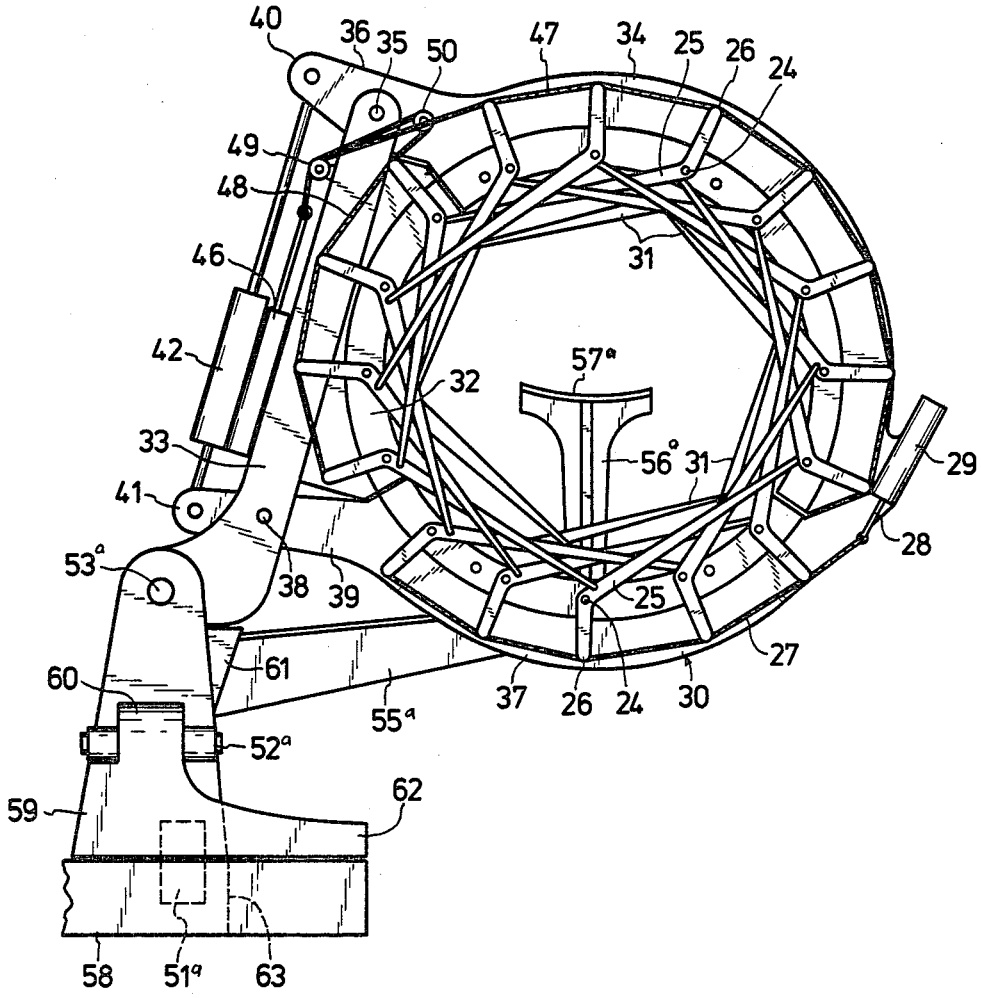
Figure 7:
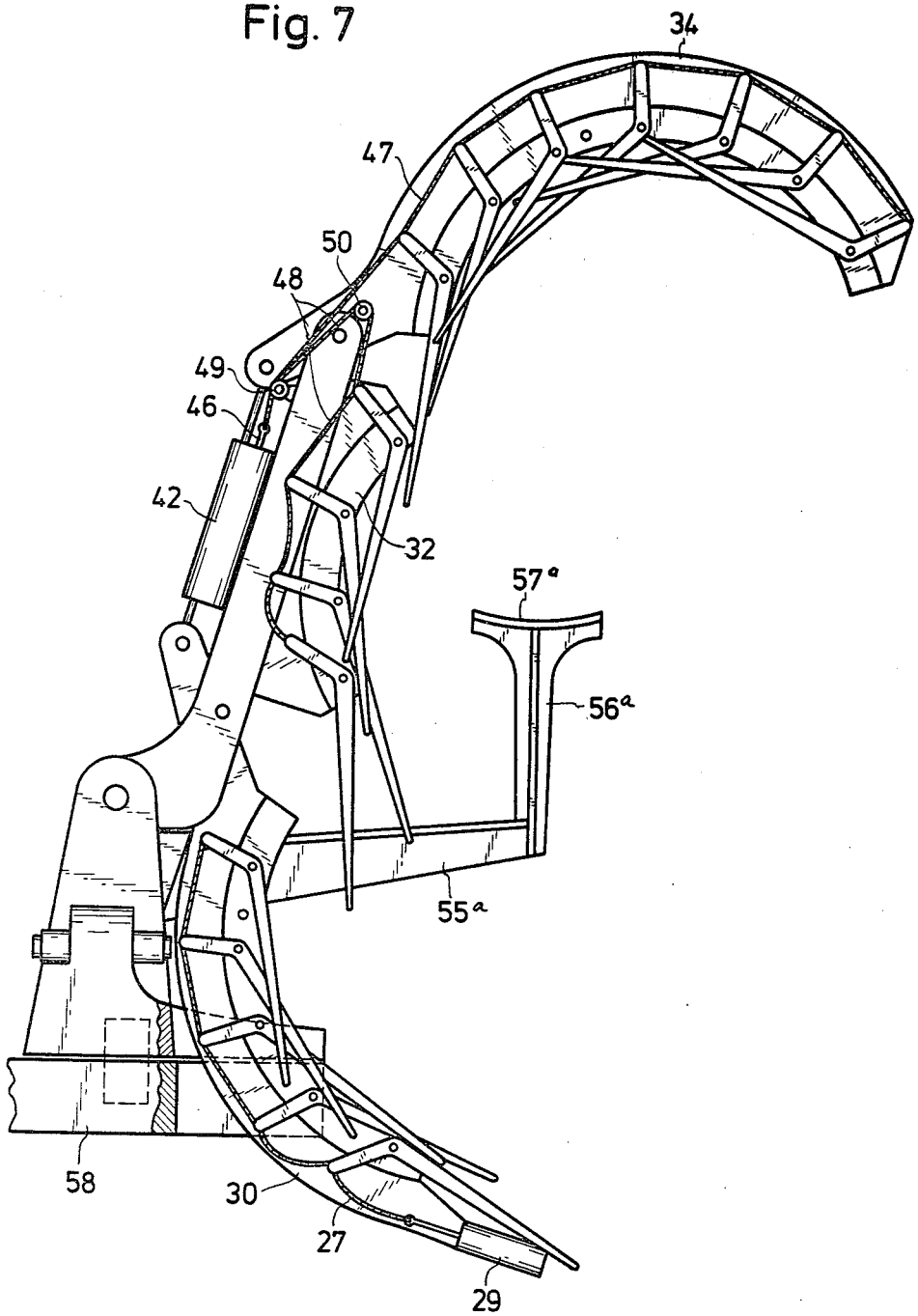

FIG. 4 is a section in part, along line IV—IV of FIG. 3;

FIG. 5 is an elevational view, partly in section, in the direction of line III—III in FIG. 2 of a modified embodiment;

FIG. 6 is a side elevational view of another embodiment of the invention; and FIG. 7 shows the embodiment of FIG. 6 in open position; and FIG. 8 shows partial section through peeling mechanism with return springs engaging against knife shafts.

FIELD OF THE INVENTION

In accordance with one embodiment of the invention there is provided a plurality of knives for cutting off branches and of knives for removing the bark, these knives being evenly distributed and swingably secured to shafts which extend parallel with respect to the longitudinal central axis of the ring member, whereby the knives are resiliently pressible against the tree trunk being moved through the ring member. The knives for removing the bark are arranged on the forward side, viewed in the direction of movement of the tree trunk, whereby their respective broad sides pointing toward the trunk exhibit a small angle of incidence with respect to the trunk upper surface. The knives for cutting off branches are arranged on the rearward side of the ring member, viewed in the direction of movement of the trunk, and their respective broad sides pointing toward the trunk extend in parallel with the tree upper surface. Furthermore, the cutting edges of the knives for removing the bark stand with respect to the plane of the ring member at an angle of about from 20° to 60° while the cutting edges of the knives for cutting off branches are arranged parallel with respect to the plane of the ring member. In addition, the knives for removing bark and the knives for cutting off branches are staggered in the direction of the axis of the ring member. Such staggered arrangement can be provided in two sections extending over 180° each and will serve to reduce the overall length of the knife apparatus. In order to place the trunk laterally into the ring member, the ring member can be separable in three sections whereby one substantially perpendicularly extending section is fast secured to a carrying part. The other two sections of the ring member comprise fast combined lever arms by means of which the two sections are linked to the carrying part whereby the lever arms are swingable, through the intervention of hydraulic or electrical drive means, for opening and closing of the ring member.

In order to align the ring member in its plane with respect to the direction of the trunk to be worked on, and, as well, in order to control the ring member with respect to the changes of direction of the tree with respect to the vertical plane on pulling of the trunk through the ring member, the carrying part can be arranged to be swingable in the perpendicular plane on a link part about a pivot axis of a link means. The link part, in turn, can be swingable with respect to the base member carrying the apparatus or with respect to a base plate about the pivot axis of the link means permitting movement through substantially 360° in the horizontal plane. The link part, furthermore, can be swingable in the perpendicular plane about a pivot axis of a further link means through 20° with respect to both sides of the vertical, whereby the swinging planes of the further link means extends perpendicularly with respect to the swinging plane of the link means on the carrying part.

The apparatus can be swung by means of the link means permitting movement through substantially 360° onto the associated vehicle or in the direction of the interior of the base plate, either during transport or when at rest. Adjustment of the apparatus with respect to trunks delivered in various directional attitudes can be accomplished in a corresponding manner. Due to the swingability on the link means for the carrying part, the height or level of the ring member can be adjusted with respect to varying trunk diameters. Due to the swingability of this link part in the vertical plane, the ring member can follow the changes in direction of a trunk on pulling thereof through the ring member. Particularly during the latter movement the ring member automatically adopts a position in the perpendicular plane with respect to the tree axis.

Drive elements for swinging movement of the knives for removing the bark and for the knives for cutting off branches can be disposed in the hollow interior of the ring member, the drive elements being preferably hydraulic drive elements.

Further embodiments and characteristic features of the invention are presented as the specification proceeds.

DETAILED DESCRIPTION

Now turning to the drawings, the embodiment shown in FIGS. 1–4 comprises a ring member 1 encircling the tree trunk, not shown, which ring member 1 is equipped on the viewing side with sixteen knives for removing bark, or peeling knives, generally designated by the numeral 2, said knives for removing bark tangentially engaging the trunk of the tree, not shown. On the other side of ring member 1, there are provided six or eight knives, generally designated by the numeral 3, for cutting off tree branches (FIG. 2). The peeling knives 2 are shown with their backs in FIG. 1 and engage the trunk, which is pulled through the ring member 1, with their cutting edges 5 at a small cutting angle. The knives 2 are replaceably secured on rotatable shafts 4. Shafts 4 are perpendicularly journalled in the ring member 1 and can be swingably moved together and at the same rate toward the center of the ring member 1 by the intervention of drive means to be discussed further below. They thus form a circle of knife edges which is adaptable to the circumference of the tree trunk to be worked on, which circle is approximately formed by sixteen equidistant tangents whereby the bark of the tree can be uniformly and completely removed or peeled from the tree trunk.

Each of the peeling knives 2 points in the direction opposite to the direction of travel of the tree trunk axially through the ring member 1 having first and second axially spaced surfaces, and is arranged at an angle with respect to the longitudinal central axis of its respective shaft 4, which angle is approximately 30°, so that the free end of a knife is further removed from the associated surface of the ring member 1 than the corresponding attachment end by which it is attached to a shaft 4. This arrangement will result in a draw cutting whereby the effort required for moving the tree through the ring member, and the strain of the knives and the knife shafts, as well as the bearings therefor, is substantially reduced. The knives 2 are staggered amongst each other in the direction of the tree trunk axis at such a distance as is required to avoid contact with each other at the cross-over points. Thus, the shafts 4 are of various lengths. The staggered arrangement is provided by two sections each comprising eight knives. This will result in a beneficial shortening of the peeling sections of the apparatus (FIG. 2).

The cutting knives 3 for cutting off branches are arranged in a similar manner on somewhat stronger shafts 6. Shafts 6 are perpendicularly disposed with respect to the plane of the ring member 1, but on the other side of the ring member 1 (FIG. 2) and are rotatably journalled therein. The knives 3 tangentially engage the tree trunk, without an angle of incidence, or only with a very small angle, and their cutting edges extend at an angle of 90° with respect to the longitudinal central axes of shafts 6. The knives 3 are also staggered in the direction of the tree trunk axis by a distance corresponding to their respective widths, due to the afore mentioned angle of incidence of 90°. Again, for shortening of the overall length of the knife assembly a grouping into two sections is provided (FIG. 2).

As can be seen in FIG. 2, the ring member 1 is comprised of two rings 8 and 9, respectively, which are bolted to each other so as to provide a unitary structure, each ring having a generally rectangular cross section in which the drive elements for the knife shafts 4 and 6 are arranged.

The drives of the knife shafts are diagrammatically represented in FIGS. 3 and 4. The knife shafts of the peeling knives 2 are rotatably journalled in the radial walls 10 and 11 of the ring 8. Gears 12 are secured to the ends of knife shafts 4 which gears mesh with intermediate gears 13, the latter also being journalled on shafts 14 in walls 10 and 11. The drive for the meshing gears is a hydraulic rotary piston cylinder or motor 15 which is secured with its housing 16 to the wall 11. The rotary piston cylinder 15 has two working chambers 17 and 18, respectively, in which a rotary piston 19 is movable.

This rotary piston 19 is secured to drive gear 20 which meshes with neighboring gears 12 of the knife shafts 4. Preferably, gears 13, 14 and 20 have the same diameter.

A further embodiment of the drive for the knife shafts 4 is shown in FIG. 5. These knife shafts 4 have gears 21 disposed in the ring section 8, which gears 21 are engaged by a belt 22 with internal teeth, the belt traversing about the drive gear 20*a* of a hydraulic rotary piston cylinder or motor 15*a*, not shown, and being returned in contact with internal wall 23 of ring 8, whereupon it again engages the gears 21. Usefully, two or three of such hydraulic drive units and gear/stroke belt combinations are provided in uniform distribution over the circumference of ring 8.

Similar drive arrangements are provided in ring 9 for the knives 3, whereby, usefully, an arrangement in accordance with FIG. 5 is selected since with the reduced number of knives the gears may be too large.

In the pressure oil conduit system which supplies pressure for the hydraulic rotary piston motor 15, there is usefully provided a closed container for compressed air, not shown, in order to provide for a resilient pressing of the knives against the tree trunk. This is necessary so as to control the knives to follow independently any uneveness of the tree trunk, to avoid an entry of the cutting edges into the wood, and their blockage and breaking.

A further embodiment of the control of the knives for removing the bark and for cutting off the branches is shown in FIG. 6. The peeling knives 25 swingably mounted on shafts 24 comprise lever arms 26 to which, at equal distances, a wire rope 27 is secured which has one end secured to the piston 28 of a hydraulic cylinder 29. The knife shafts 24 are rotatable, in reaction to the force of springs, not shown, preferably provided within the ring 30, by retraction of the piston 28. A similar adjustment arrangement incorporating a wire rope and a hydraulic cylinder, not shown, is provided for the knives 31 for cutting off the branches which are adjusted in the embodiment shown in FIG. 6 for a tree trunk of small diameter in order to expose them to viewing within the inner diameter of the ring member 30.

Figure 1:
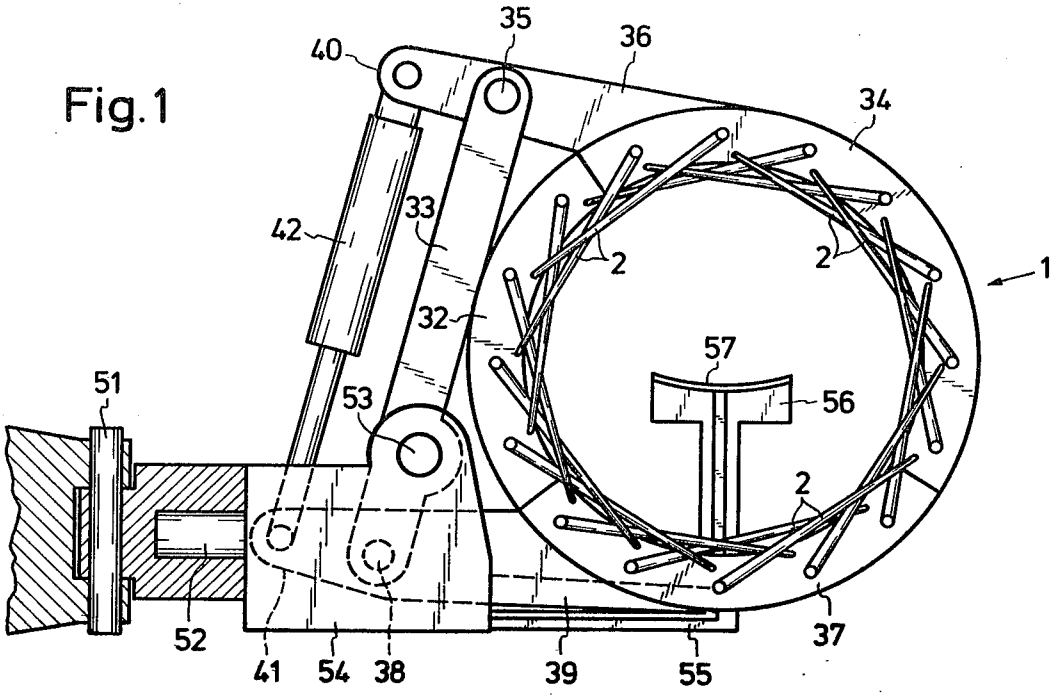
FIG. 1 is a side elevational view, partly in section, of an embodiment in accordance with the invention.

The closed ring members 1 and 30, respectively, are only useful for a stationary operation of the apparatus. For such an operation and for utilization in the forest, a ring member which can be separated and which is capable of being swung open is more useful. FIGS. 1 and 6 show ring members 1 and 30, respectively, which are formed of three sections. In view of the functional agreement of the two embodiments with respect to opening and closing the ring member, the corresponding parts of the embodiment shown in FIG. 6 have been identified with corresponding numerals and the letter a; unless specifically mentioned, these parts carry out corresponding movements and perform corresponding functions. The substantially perpendicular disposed section 32 is secured to a carrying part 33. Upper section 34 having a lever arm 36 and the lower section 37 having a lever arm 39 are, respectively, articulatedly connected to carrying part 33, the pivot axes being designated by numerals 35 and 38 respectively. Between the other end 40 of the lever arm 36 and the other end 41 of lever arm 39 there is articulatedly mounted a hydraulic cylinder 42. Respective actuation of the piston of cylinder 42 causes on lifting of the upper section 34 and lowering of the lower section 37 opening and, respectively, closing of the ring members 1 or 30, respectively. FIG. 7 shows the ring member 30 in open position, it being understood that the embodiment shown in FIG. 1 can also assume this position.

When using a ring member 1 comprised of a plurality of sections, it is useful to provide for each section an individual hydraulic rotory piston cylinder or motor such as rotary motor 15. At least for a belt/gear arrangement in accordance with FIG. 5, for each section a separate gear belt and a separate rotary piston motor will be required. In the gear arrangement in accordance with FIGS. 3 and 4, the gap 43 (FIG. 3) can be arranged so that a gear 44 extends beyond the limit of the section; and on closing of the ring member 1 it meshes again with the first gear 45 of the adjacent section. FIG. 3*a* shows hydraulic drives 15 for the knife shafts and including two working chambers 18, 19 alternately pressurized and/or relieved to effect desired rotation of knife shafts. FIG. 3*b* shows electromotors 64 rigidly arranged in the knife ring 8 provided with output pinions 65 which engage gears 64 on knife shafts 4 to effect forward respectively rearward rotation.

In that case only a single hydraulic rotary piston motor is required which is usefully provided on the carrying part 33 in order to avoid tubular oil conduits leading to the movable sections 34 and 37.

In the embodiment shown in FIG. 6, on the right side in the drawing, a cylinder 29 is provided on the lower section 37. For varying the position of the knives of the perpendicular section 32 and of the upper section 34, there can be provided for the knives of each of the two sections, respectively, a cylinder 46 on the carrying part 33 to which is passed a wire rope 47 for the upper section 34 and a wire rope 48 for the vertical section 32, both ropes being passed over a roller 49, and the wire rope 48, furthermore, being passed or being guided by a roller 50. The arrangement for the cutting knives on the other side of the ring member, not shown, is in like manner.

Adjustment of the debarking and cutting knives can also be achieved in a manner such that on the ring member 1 for each knife shaft there is provided an individual hydraulic rotary piston cylinder or motor which can be controlled individually, in groups, or together.

Furthermore, instead of hydraulic elements, electric rotary magnets or electric variable speed motors can be provided. Also, instead of hydraulic cylinders 42, one or two electric variable speed motors can be provided.

In the embodiment shown in FIG. 1 a joint 51 having a perpendicularly disposed longitudinal central axis permits pivotal movement of the apparatus in the horizontal plane. This is necessary in order to present the ring member respectively in perpendicular attitude to the trees which are delivered in varying angular attitudes, which perpendicular positioning is effected automatically on pulling the tree trunks through the ring member. This joint can also be used for the device for transporting the tree trunk onto the vehicle, not shown. By means of a further joint 52 having a horizontally disposed longitudinal central pivot axis, the apparatus is swingable with respect to the vertical plane through an angle of about 20° to both sides, the movement being limited by abutments, not shown. This has also the purpose to adjust the ring member 1 perpendicularly with respect to the trunk on movement of the trunk therethrough.

The ring member 1 is, furthermore, swingable in its own plane about a joint 53 which has a horizontally disposed central longitudinal pivot axis which extends transversely with respect to the aforementioned joints 51 and 52, the downward movement of the apparatus being limited by an abutment, not shown, in the position shown in FIG. 1. This affords adjustment of the ring member 1 to the varying tree trunk diameters.

The joint 53 is provided in joint base 54 which also carries the joints 51 and 52 and forms part of the carrying part 33 so that on swinging about the axis of rotation provided by this joint 53, the ring member 1 and its opening and closing mechanisms are carried along.

In the joint part 54 there is secured on a bent arm 55 a tree trunk support 56 which, accordingly, will carry out movement about the pivot axes of joints 51 and 52 but not movement about the axis of joint 53. This tree trunk support 56 is provided, when viewed in the direction of the tree trunk transport, ahead of ring member 1, i.e., it is positioned immediately ahead of the cutting knives 3 for cutting off the branches. Its forward edge, when viewed in the direction of movement of the tree, is formed as cutting knife 57 in order to cut off branches which come into contact with the tree support 56.

In the embodiment according to FIGS. 6 and 7 there is provided on a base plate 58, secured to a vehicle, not shown, a pivot-like joint part 59 which includes the three joints 51*a*, 52*a*, and 53*a*, carrying out the functions of the joints 51, 52, and 53 as described earlier. The abutment provided on the viewing side in FIG. 6 for joint 52 is shown at numeral 60; a counter part being symmetrically provided on the other side of joint part 59. Furthermore, there is provided on the joint part 59 an abutment 61 for the lowering of the ring member 37 and, as well, for the bent arm 55*a* of trunk support 56*a*. The joint part 59 comprises two feet 62 and 63 which extend in the direcion of the ring member 30 and which are supported on the base plate 58 between which feet there is a cutout 64 which provides room for lowering of the lower section 37.

The operation of the apparatus is as follows: On opening of the ring member 1 or 30, respectively, the tree trunk to be worked on is placed on the trunk support 56 or 56*a*, respectively. On closing of the respective sections to assume the positions indicated in FIGS. 1 and 6, and simultaneous movement of the knives into engagement/cutting position, the ring member surrounds and the knives come into contact with the tree whereby the tree is lifted more or less in relation with its diameter. The ring member now concentrically surrounds the trunk and the knives are resiliently pressed against the tree in working position. Since the lower tree ends are normally devoid of branches, the rearward positioning of the means for removing the branches does not interfere. The bark removal means can directly attack at the lower end of the tree trunk, this being gripped by a claw secured to a tractor or other pulling device, not shown. On pulling by means of such a pulling device, the ring member 1 or 30, respectively, adjust perpendicularly with respect to the longitudinal central tree trunk axis and follows in this manner the further movement of the trunk, thus it is primarily disposed in the vertical attitude. The knives for cutting off the branches lying flat on the trunk remove in chisel action approaching branches while the debarking knives, due to their angle of incidence, penetrate into the bark down to the wood of the tree and thereby effect removal of the bark. As the diameter of the trunk being pulled through the apparatus decreases, the central axis thereof moves closer towards the tree support 56 with the knives accompanying this further movement. On further advancement, the trunk tilts forward whereby the ring is adapted to follow this movement by movement about the axis of joint 52. On re-opening of the ring, the pressure acting on the knives is decreased so that they fall in downward direction whereby material adhering to them will be removed, which may be assisted in a simple manner either manually or by spreading of the knives by the intervention of their adjustment mechanism.

The opening of the apparatus is shown in FIG. 7. The knives of the upper section are under the tension exerted by the wire rope 37. No tension is on the wire ropes 38 and 49 of the other two sections so that the knives fall loose and any material adhering thereon can readily be removed therefrom. On releasing the tension of the wire rope 47, the knives 64 move to hang perpendicularly, and adhering material is removed from them thereby. Cut-off branches will drop to the ground ahead of the ring member and can readily be removed from there.

It is, of course, to be understood that the present invention is in no way limited to the specific disclosure of the drawings but also encompasses any modifications within the scope of the appended claims.

What I claim is:

1. An apparatus for removing branches and bark from felled trees which are moved through said apparatus, said apparatus comprising:
   (a) a ring member for moving therethrough a felled tree, said ring member having first and second axially spaced surfaces;
   (b) a plurality of first knives mounted on said ring member at said first surface thereof for pivotal movement between an operative position in working engagement with the respective tree being moved through said ring member and a rest position disengaged from the tree, each of said first knives having a longitudinal central plane extending substantially perpendicular to the surface of the tree and cutting edge for cutting off branches from the tree, said cutting edge extending substantially parallel to said first surface;
   (c) a plurality of second knives mounted on said ring member at said second surface thereof for pivotal movement between an operative position in working engagement with the tree and a rest position disengaged from the tree, each of said second knives having a longitudinal central plane extending at a small angle with respect to the surface of the tree and a cutting edge for removing bark from the tree after cutting off the branches, said second knife cutting edge extending at an angle of from 20° to 60° with respect to said second surface; and
   (d) means for retaining said first and second knives in resilient engagement with the tree in their operative position.

2. An apparatus according to claim 1, wherein both said first knives and said second knives are staggered in the direction of the axis of said ring member.

3. An apparatus in accordance with claim 1, wherein said ring member comprises three ring sections.

4. An apparatus in accordance with claim 3, wherein said ring member includes:
   a carrying part;
   a first ring section extending substantially perpendicular with respect to ground level and secured to said carrying part;
   a pair of complementary ring sections each including a lever arm pivotally joined to the carrying part; and means for moving said complementary ring sections into a ring opening position and into a ring closing position.

5. An apparatus in accordance with claim 4, wherein said means for moving said complementary ring sections includes hydraulic piston and cylinder means.

6. An apparatus in accordance with claim 4, wherein said means for moving said complementary ring sections includes pneumatic piston and cylinder means.

7. An apparatus in accordance with claim 4, wherein said carrying part is pivotally mounted on a linking base member for swingable movement thereof in the vertical plane.

8. An apparatus in accordance with claim 7, wherein said linking base member is pivotally mounted for angular displacement of said ring member with respect to its vertical plane.

9. An apparatus in accordance with claim 8, wherein angular displacement is through an arcuate path of about 20° to either side of the vertical.

10. An apparatus in accordance with claim 8, wherein said ring member is pivotally mounted for displacement in the horizontal plane about a vertical axis.

11. An apparatus in accordance with claim 3, wherein each ring section includes drive means for driving those of said first and second knives which are mounted on the respective ring section.

12. An apparatus in accordance with claim 11, wherein said drive means include shaft means connected to said drive means, knife rotating gears secured to said shaft means carrying said first and second knives and intermediate gears disposed between, and meshing with said knife rotating gears, at least one of said knife rotating and intermediate gears meshing with a drive gear of said drive means.

13. An apparatus in accordance with claim 11, wherein said drive means includes knife rotating gears secured to the shaft means carrying said first and second knives; at least one driving gear, and continuous power transmission means for transmitting motive power from said at least one driving gear to said knife rotating gears.

14. An apparatus in accordance with claim 13, wherein said continuous power transmission means includes a continuous belt having interior teeth.

15. An apparatus in accordance with claim 1, wherein said ring member is hollow and wherein said drive means for driving said first and second knives between their operative and rest positions are disposed in the hollow interior of said ring member.

16. An apparatus in accordance with claim 15, wherein the drive means include hydraulic rotary piston motors.

17. An apparatus in accordance with claim 15, wherein said ring member comprises three ring sections, and said drive means includes one common driving member for driving the knives mounted on all said ring sections.

18. An apparatus in accordance with claim 17, wherein said drive means includes knife rotating gears mounted on said shaft means carrying said knives, and at least one intermediate gears disposed between, and meshing with, the said knife rotating gears, one of said intermediate gears of each ring section extending beyond the boundary of said ring section to mesh with a gear of the adjacent ring section when said ring member is closed.

19. An apparatus in accordance with claim 1, wherein said first and second knives comprise lever arms extending away from respective pivot axes; and further including:

a wire rope equidistantly joining said lever arms;

cylinder and piston means connected to one end of said wire rope for moving said first and second knives to their operative positions; and means for resiliently returning said first and second knives to their rest positions.

20. An apparatus in accordance with claim 18, wherein said cylinder and piston means includes hydraulic cylinder and piston means.

21. An apparatus in accordance with claim 19, wherein said ring means comprises three ring sections, each ring section being provided with a wire rope and a hydraulic cylinder and piston means.

22. An apparatus in accordance with claim 1, further including a support member for maintaining thereon the tree trunk in substantially concentrical relationship with respect to the ring member, said support member being swingable about a pivot axis and having a cutting edge for cutting off tree branches.

* * * * *